US011067926B2

(12) United States Patent
Hashiguchi et al.

(10) Patent No.: US 11,067,926 B2
(45) Date of Patent: Jul. 20, 2021

(54) IMAGE FORMING APPARATUS THAT CONDITIONALLY EXTENDS A PREPARATORY ROTATION TIME UNTIL A RECORDING MATERIAL ENTERS A FIXING PORTION

(71) Applicant: CANON KABUSHIKI KAISHA, Tokyo (JP)

(72) Inventors: Shinji Hashiguchi, Hiratsuka (JP); Munehito Kurata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/715,340

(22) Filed: Dec. 16, 2019

(65) Prior Publication Data

US 2020/0201215 A1 Jun. 25, 2020

(30) Foreign Application Priority Data

Dec. 19, 2018 (JP) ..... JP2018-236911

(51) Int. Cl.
*G03G 15/20* (2006.01)
*G03G 15/08* (2006.01)

(52) U.S. Cl.
CPC ..... *G03G 15/2039* (2013.01); *G03G 15/0808* (2013.01); *G03G 15/2028* (2013.01)

(58) Field of Classification Search
None
See application file for complete search history.

(56) References Cited

U.S. PATENT DOCUMENTS 8,472,826 B2 6/2013 Hashiguchi
10,031,449 B2 7/2018 Hashiguchi et al.
2005/0265741 A1* 12/2005 Otsuka ..... G03G 15/2039 399/69

(Continued)

FOREIGN PATENT DOCUMENTS

JP 2004-333822 A 11/2004
JP 2011-191586 A 9/2011

(Continued)

OTHER PUBLICATIONS

JP_2014081473_A_T MachineTranslation, Japan, Shutaro et al, 2014.*

(Continued)

*Primary Examiner* — Victor Verbitsky
(74) *Attorney, Agent, or Firm* — Venable LLP

(57) ABSTRACT

An image forming apparatus that forms an image on a recording material has a second image forming mode that (i) controls the target control temperature of a heater to be lower than in a normal image forming mode and at least (ii) extends a period of time from the start of image forming to a point of time at which the recording material reaches the nip portion to be longer than in the normal image forming mode based on (A) recording material information indicating the hardness of the recording material, at least one of (B) margin information indicating the size of the margin at the leading end in the transport direction of the recording material and (C) toner amount information at the leading end of the image formed on the recording material, and (D) information of an environment in which the image forming apparatus is installed.

15 Claims, 7 Drawing Sheets

TABLE A

| | | IMAGE LEADING-END PRINT RATIO INFORMATION | | |
|---|---|---|---|---|
| | | ~30% | 30~80% | 80%~ |
| LEADING-END MARGIN INFORMATION | ~2mm | MODE 3 | MODE 4 | MODE 4 |
| | 2mm~5mm | MODE 1 | MODE 2 | MODE 2 |
| | 5mm~ | NO COUNTERMEASURE | NO COUNTERMEASURE | MODE 1 |

TABLE B

| | | IMAGE LEADING-END PRINT RATIO INFORMATION | | |
|---|---|---|---|---|
| | | ~30% | 30~80% | 80%~ |
| LEADING-END MARGIN INFORMATION | ~2mm | MODE 1 | MODE 2 | MODE 3 |
| | 2mm~5mm | NO COUNTERMEASURE | MODE 1 | MODE 3 |
| | 5mm~ | NO COUNTERMEASURE | NO COUNTERMEASURE | NO COUNTERMEASURE |

TABLE C

| | | IMAGE LEADING-END PRINT RATIO INFORMATION | | |
|---|---|---|---|---|
| | | ~30% | 30~80% | 80%~ |
| LEADING-END MARGIN INFORMATION | ~2mm | MODE 4 | MODE 4 | MODE 4 |
| | 2mm~5mm | MODE 2 | MODE 2 | MODE 4 |
| | 5mm~ | NO COUNTERMEASURE | MODE 1 | MODE 2 |

(56) References Cited

U.S. PATENT DOCUMENTS

2018/0129162 A1* 5/2018 Takahashi ..... G03G 15/0126

FOREIGN PATENT DOCUMENTS

| | | | |
|---|---|---|---|
| JP | 2014-041233 | A | 3/2014 |
| JP | 2014-081473 | A | 5/2014 |
| JP | 2015-079212 | A | 4/2015 |
| JP | 2016-065962 | A | 4/2016 |

OTHER PUBLICATIONS

Co-pending U.S. Appl. No. 16/779,991, filed Feb. 3, 2020 (not prior art).

* cited by examiner

| | | IMAGE LEADING-END PRINT RATIO INFORMATION | | |
|---|---|---|---|---|
| | | ～30% | 30～80% | 80%～ |
| LEADING-END MARGIN INFOR-MATION | ～2mm | MODE 3 | MODE 4 | MODE 4 |
| | 2mm～5mm | MODE 1 | MODE 2 | MODE 2 |
| | 5mm～ | NO COUNTER-MEASURE | NO COUNTER-MEASURE | MODE 1 |

FIG.7

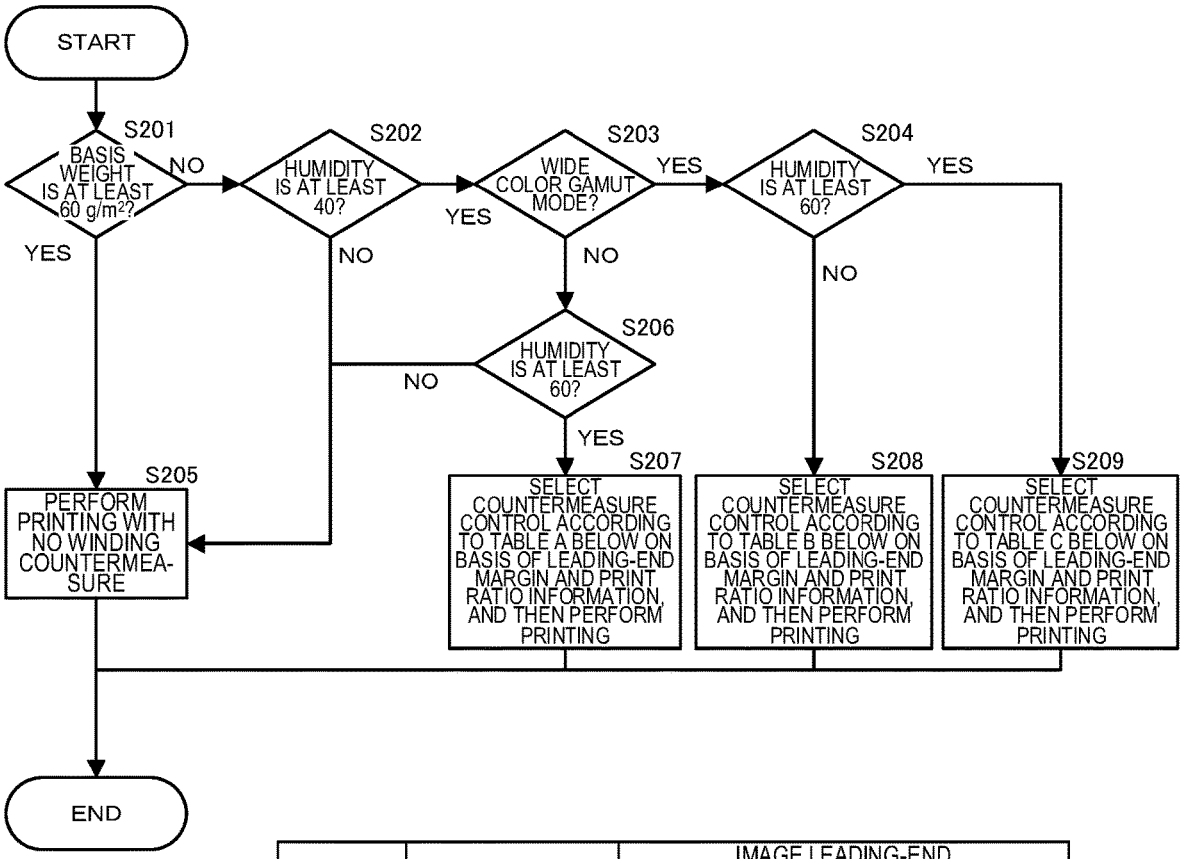

TABLE A

| | | IMAGE LEADING-END PRINT RATIO INFORMATION | | |
|---|---|---|---|---|
| | | ~30% | 30~80% | 80%~ |
| LEADING-END MARGIN INFORMATION | ~2mm | MODE 3 | MODE 4 | MODE 4 |
| | 2mm~5mm | MODE 1 | MODE 2 | MODE 2 |
| | 5mm~ | NO COUNTERMEASURE | NO COUNTERMEASURE | MODE 1 |

TABLE B

| | | IMAGE LEADING-END PRINT RATIO INFORMATION | | |
|---|---|---|---|---|
| | | ~30% | 30~80% | 80%~ |
| LEADING-END MARGIN INFORMATION | ~2mm | MODE 1 | MODE 2 | MODE 3 |
| | 2mm~5mm | NO COUNTERMEASURE | MODE 1 | MODE 3 |
| | 5mm~ | NO COUNTERMEASURE | NO COUNTERMEASURE | NO COUNTERMEASURE |

TABLE C

| | | IMAGE LEADING-END PRINT RATIO INFORMATION | | |
|---|---|---|---|---|
| | | ~30% | 30~80% | 80%~ |
| LEADING-END MARGIN INFORMATION | ~2mm | MODE 4 | MODE 4 | MODE 4 |
| | 2mm~5mm | MODE 2 | MODE 2 | MODE 4 |
| | 5mm~ | NO COUNTERMEASURE | MODE 1 | MODE 2 |

IMAGE FORMING APPARATUS THAT CONDITIONALLY EXTENDS A PREPARATORY ROTATION TIME UNTIL A RECORDING MATERIAL ENTERS A FIXING PORTION

BACKGROUND OF THE INVENTION

Field of the Invention

The present invention relates to an image forming apparatus having an image heating device that heats an image on a recording material. The image heating device is, for example, a fixing device that heats and fixes an unfixed image onto a recording material as a permanent image, a heating device that temporally fixes an unfixed image onto a recording material, a heating device that reheats a recording material bearing an image to modify the surface performance of an image such as luster and the like.

Description of the Related Art

In a general image forming apparatus, an image forming portion forms a visible image by supplying a developer such as toner to an electrostatic latent image formed on a photoreceptor. Then, the visible image formed by toner is transferred to a sheet transported from a paper feed cassette to an image forming portion. Next, the sheet to which the visible image of toner has been transferred is transported to a fixing device and the toner is fixed to the sheet by heating and pressurization in the fixing device.

In recent years, support for a recording material (thin sheet) having a small basis weight is needed because of increase in consciousness about environment resource preservation. Since the hardness of a thin sheet is normally low, characteristic behavior such as curl and wrinkles of the sheet is apt to occurs easily. When the hardness of the sheet is low as described above, the thin sheet is not easily separated from a fixing sleeve.

In addition, the viscosity of toner may cause a jam (winding jam) in which the recording material is not separated from the fixing sleeve and is wound around the fixing sleeve. This winding jam occurs frequently regardless of the type of a sheet when the margin of the front-end portion in the transport direction of the sheet is small and a toner image is formed in the front-end portion.

The winding jam easily occurs when the adhesion force between the toner image and the fixing material is large at the leading end in the transport direction of the recording material. In addition, the winding jam also occurs easily when the hardness of the recording material is low.

The adhesion force between the toner image and the fixing material is significantly affected by the amount of toner formed at the leading end of the recording material, the front-end margin amount, and the temperature of the fixing member.

On the other hand, the hardness of the recording material is significantly affected by the basis weight and the hygroscopic state of the recording material.

Accordingly, there is proposed a method that lowers the fixation temperature (target control temperature) when it is determined that a winding jam easily occurs by detecting the hygroscopic state of the recording material to prevent a winding jam (Japanese Patent Application Publication No. 2004-333822). In addition, there is proposed a method that changes the amount of toner and the fixation temperature according to the basis weight of a recording material (Japanese Patent Application Publication No. 2014-81473). In addition, there is proposed a method that enlarges the front-end margin when it is determined that a winding jam easily occurs on the basis of the type, humidity, and image information of a recording material (Japanese Patent Application Publication No. 2016-65962).

SUMMARY OF THE INVENTION

However, as described in Japanese Patent Application Publication No. 2004-333822, the fixing performance tends to degrade when the fixation temperature is lowered. Accordingly, when the fixation temperature needs to be lowered significantly to prevent a winding jam, it is difficult to meet the fixing performance. In addition, as described in Japanese Patent Application Publication No. 2014-81473 and Japanese Patent Application Publication No. 2016-65962, when the front-end margin is changed or the amount of toner is changed, the image position or the image density desired by the user may not be achieved.

An object of the present invention is to provide a technique capable of suppressing the winding of a recording material around a film without affecting image heating processing and image forming.

To achieve the object described above, an image forming apparatus according to the present invention includes:

an image forming portion that forms an image on a recording material;

an image heating portion including a cylindrical film, a heater that comes into contact with an inner surface of the film, and a pressurizing member that forms a nip portion by coming into contact with an outer surface of the film so as to sandwich the film between the pressurizing member and the heater, the image recording material being nipped and transported by the nip portion and the image being heated by heat of the heater; and a control portion that controls the image forming portion and the image heating portion, wherein the control portion has a second image forming mode that (i) controls a target control temperature of the heater to be lower than in a normal image forming mode and at least (ii) extends a period of time from start of image forming to a point of time at which the recording material reaches the nip portion to be longer than in the normal image forming mode based on (A) recording material information indicating hardness of the recording material, at least one of (B) margin information indicating a size of a margin at a leading end in a transport direction of the recording material and (C) toner amount information at the leading end of the image, and (D) information of an environment in which the image forming apparatus is installed.

According to the present invention, the winding of a recording material around a film can be suppressed without affecting image heating processing and image forming.

Further features of the present invention will become apparent from the following description of exemplary embodiments (with reference to the attached drawings).

BRIEF DESCRIPTION OF THE DRAWINGS

FIG. 7 is an explanatory diagram illustrating fixing winding countermeasure control in a second embodiment.

DESCRIPTION OF THE EMBODIMENTS

Figure 1:
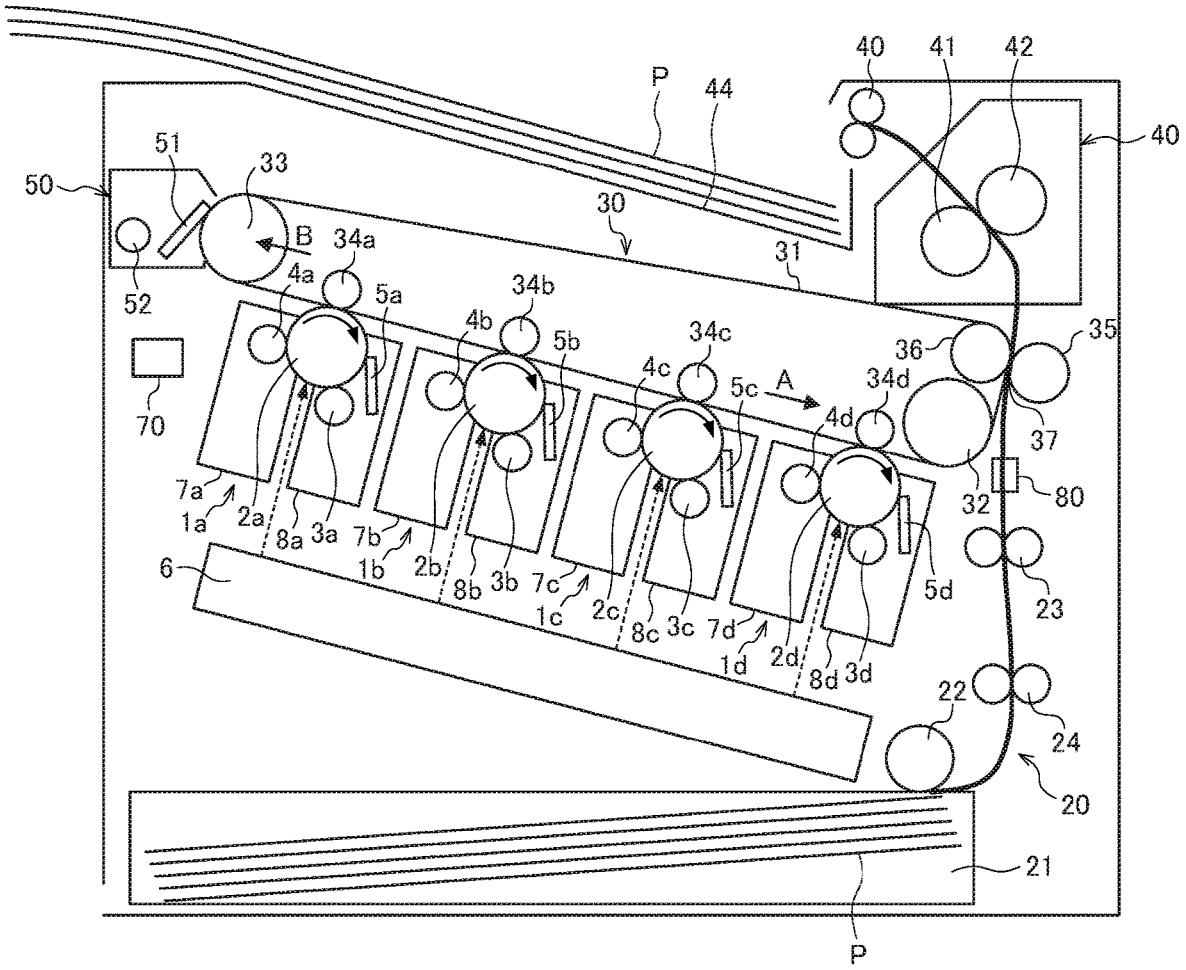
FIG. 1 is a cross-sectional explanatory diagram illustrating an image forming apparatus according to a first embodiment.

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Entire Structure of an Image Forming Apparatus

First, the entire structure of an image forming apparatus as well as an image forming operation will be described with reference to a cross-sectional schematic explanatory diagram. It should be noted here that the image forming apparatus according the embodiment is a color laser printer that adopts a transfer electrophotographic process and has a maximum process speed of 135 mm/s and a throughput (number of prints per minute) of 30 ppm (A4-size lateral feed).

The image forming apparatus according to the embodiment has toner cartridges 1*a*, 1*b*, 1*c*, and 1*d* detachable with respect to the image forming apparatus body. These four toner cartridges 1*a*, 1*b*, 1*c*, and 1*d* have the same structure, but are different in that they form images of toner with different colors, that is, yellow, magenta, cyan, and black. The toner cartridges 1*a*, 1*b*, 1*c*, and 1*d* include developing units 7*a*, 7*b*, 7*c*, and 7*d* and image bearing member units 8*a*, 8*b*, 8*c*, and 8*d*. Of these units, the former developing units 7*a*, 7*b*, 7*c*, and 7*d* have developing rollers 4*a*, 4*b*, 4*c*, and 4*d*. In addition, the latter image bearing member units 8*a*, 8*b*, 8*c*, and 8*d* include photoreceptive drums 2*a*, 2*b*, 2*c*, and 2*d* that are image bearing members, charged rollers 3*a*, 3*b*, 3*c*, and 3*d*, drum cleaning blades 5*a*, 5*b*, 5*c*, and 5*d*, and waste toner containers, respectively.

A scanner unit 6 is disposed below the toner cartridges 1*a*, 1*b*, 1*c*, and 1*d* and exposes the photoreceptive drums 2*a*, 2*b*, 2*c*, and 2*d* to light.

After the photoreceptive drums 2*a*, 2*b*, 2*c*, and 2*d* are electrically charged with a predetermined negative electric potential by the charged rollers 3*a*, 3*b*, 3*c*, and 3*d* and then electrostatic latent images are formed thereon by the scanner unit 6. The electrostatic latent images are subject to reversal development by the developing units 7*a*, 7*b*, 7*c*, and 7*d* and negative toner is attached thereto to form yellow, magenta, cyan, and black toner images (developer images).

In an intermediate transfer belt unit 30, an intermediate transfer belt 31 is stretched across a driver roller 32, a secondary transfer opposed roller 36, and a tension roller 33 and the tension roller 33 applies a tension in the direction indicated by arrow B. In addition, primary transfer rollers 34*a*, 34*b*, 34*c*, and 34*d* are provided on the inner side of the intermediate transfer belt 31 so as to face the photoreceptive drums 2*a*, 2*b*, 2*c*, and 2*d* and a transfer bias is applied by a bias applying section (not illustrated).

The photoreceptive drums 2*a*, 2*b*, 2*c*, and 2*d* rotate in the directions indicated by the arrows in the figure, respectively, and the intermediate transfer belt 31 rotates in the direction indicated by arrow A. The toner images formed on the photoreceptive drums are subject to primary transfer onto the intermediate transfer belt 31 sequentially from the toner image on the photoreceptive drum 2*a* by applying a positive polarity bias to the primary transfer rollers 34*a*, 34*b*, 34*c*, and 34*d* to form a four-color toner image. This four-color toner image is transported to a secondary transfer nip portion 37.

A supply and transport device 20 has a paper feed roller 22 that feeds a recording material (transfer material) P from a paper feed cassette 21 in which the recording material P is accommodated and a transport roller 24 that transports the fed recording material P. The recording material P transported from the supply and transport device 20 is transported to the secondary transfer nip portion 37 substantially vertically by a resist roller pair 23.

By applying a positive polarity bias to a secondary transfer roller 35 in the secondary transfer nip portion 37, the four-color toner image on the intermediate transfer belt 31 is subject to secondary transfer to the transported recording material P. The recording material P to which the toner image has been transferred is transported to a fixing device 40 and then heated and pressurized by a fixing sleeve 41 and a pressurizing roller 42 so that the toner image is fixed onto the surface thereof. The fixed recording material P is ejected to a paper delivery tray 44 by a paper delivery roller pair 43.

On the other hand, the toner remaining on the surfaces of the photoreceptive drums 2*a*, 2*b*, 2*c*, and 2*d* after the transfer of the toner image is removed by cleaning blades 5*a*, 5*b*, 5*c*, and 5*d*. In addition, the toner remaining on the surface of the intermediate transfer belt 31 after the secondary transfer to the recording material P is removed by a cleaning blade 51 of a transfer belt cleaning device 50, and the removed toner passes is recovered and transported to a waste toner recovery container (not illustrated) via a waste toner transport path 52.

An environment detection sensor 70 is provided in the image forming apparatus and detects the humidity and temperature around the image forming apparatus. The detection result is used for forming, transfer, fixing control, and the like. In addition, the detection result by the environment detection sensor 70 is also used by a countermeasure control selection portion 209, which will be described later.

System Structure

Figure 2:
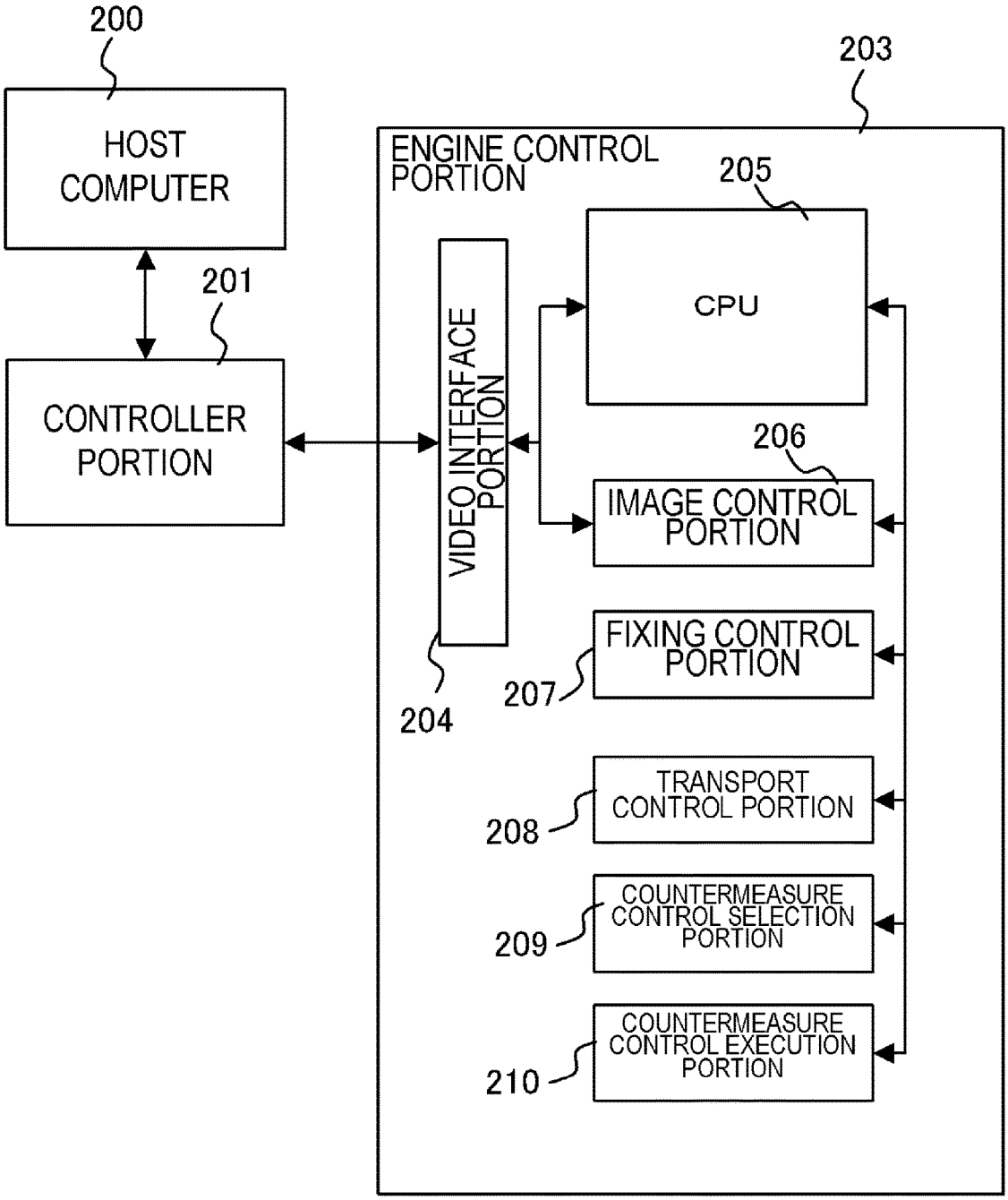
FIG. 2 is an explanatory diagram illustrating the system structure of the image forming apparatus according to the first embodiment.

FIG. 2 is an example of the system structure of the printer engine of the image forming apparatus according to the embodiment and includes a host computer 200, a controller portion 201, and an engine control portion 203. The engine control portion 203 includes a video interface portion 204, a CPU 205, an image control portion 206, a fixing control portion 207, a transport control portion 208, the countermeasure control selection portion 209, and a countermeasure control execution portion 210.

The controller portion 201 receives image information and a print command from the host computer 200, analyzes the received image information, and converts it into bit data. In addition, the controller portion 201 sends a print reservation command, a print start command, and a video signal to the engine control portion 203 for each page via the video interface portion 204. Here, the controller portion 201 calculates and obtains the image coverage ratio (front-end image coverage ratio) and the image print ratio (front-end image print ratio) of the region excluding the 6-mm width portion and the margin region at the leading end of the recording material on the basis of the image information from the host computer 200. The obtained information is reported to the engine control portion 203. The image coverage ratio is the ratio of a printed area in a predetermined range. In addition, the image print ratio is the value obtained in consideration of toner amount information (image density information) in addition to the area and obtained by dividing the total image data amount by the area in the predetermined range. In addition, the image data amount is image digital information that indicates 100% in the case of a solid image for the toner of each color.

The above image information is used as toner amount information actually printed on the recording material.

Structure of the Fixing Device

Figure 3:
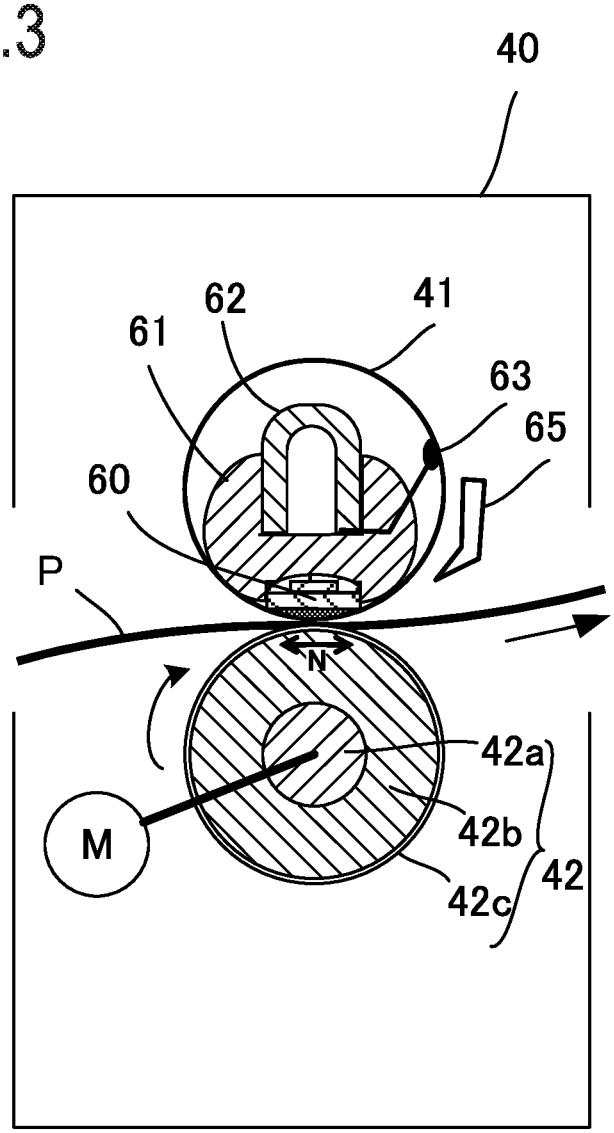
FIG. 3 is a traversal cross-sectional view schematically illustrating a heat-fixing device according to the first embodiment.

FIG. 3 is a traversal cross-sectional view schematically illustrating the fixing device (image heating device) 40 as the fixing portion (image heating portion) of the image forming apparatus according to the embodiment. The fixing device 40 according to the embodiment includes the fixing sleeve 41 as a cylindrical film of a flexible member, the pressurizing roller 42 as a pressurizing member, and a heater 60 as a heating member that comes into contact with the inner surface of the fixing sleeve 41. By pressurizing the pressurizing roller 42 toward the heater 60 via the fixing sleeve 41, a fixing nip portion N is formed between the outer surface of the pressurizing roller 42 and the outer surface of the fixing sleeve 41. The fixing nip portion N nips and transports the recording material P and the heat of the heater 60 fixes the unfixed toner image formed on the recording material P to the recording material P. In addition, a temperature sensing element 63 is inscribed in the fixing sleeve 41 and used to control the fixation temperature (target control temperature).

Fixing Sleeve

Figure 4:
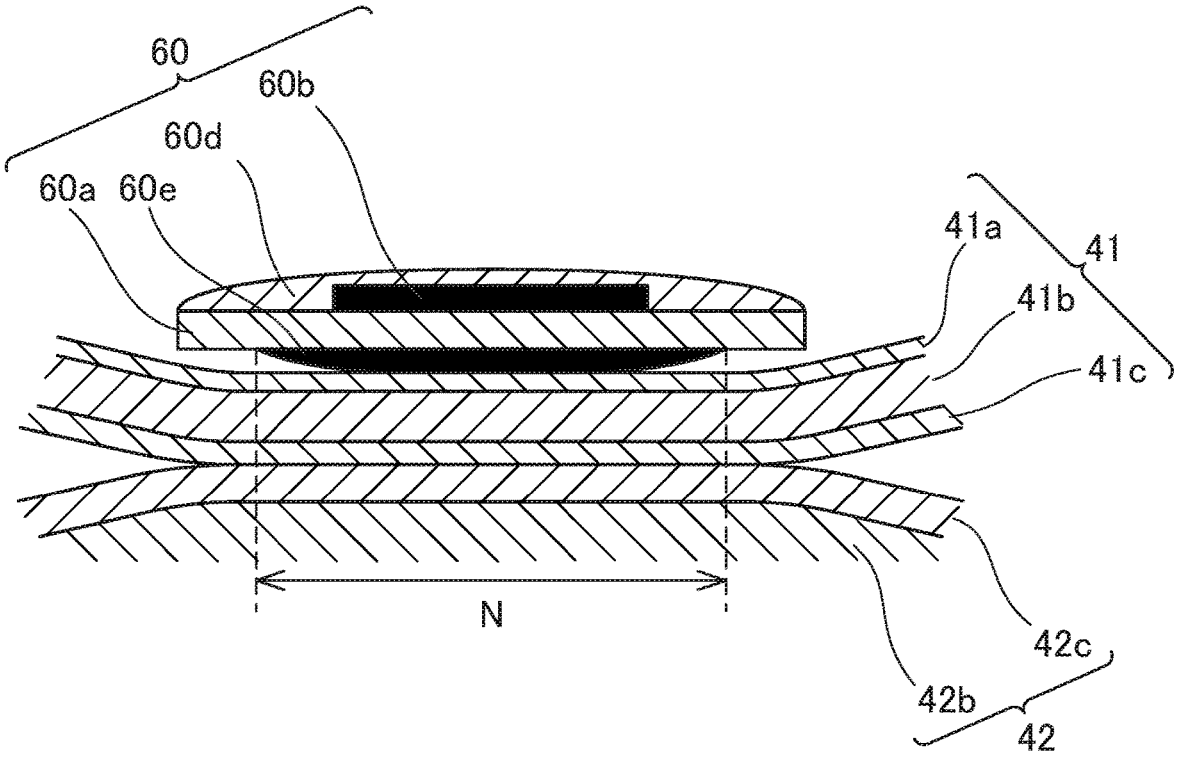
FIG. 4 is a cross-sectional enlarged view in the traverse direction schematically illustrating the vicinity of a nip portion of the heat-fixing device according to the first embodiment.

As illustrated in FIG. 4, in the fixing sleeve 41, an elastic layer 41*b* is formed on the outer periphery of a base layer 41*a* formed in an endless manner and a releasable layer 41*c* is formed on the outer periphery of the elastic layer 41*b*. This fixing sleeve 41 is formed in a cylinder having an outer diameter of 24 mm.

The base layer 41*a* is made of a resin material such as polyimide or a metal material such as SUS. In the embodiment, a 30-μm thick SUS sleeve formed in an endless manner is used in consideration of strength.

A material having as high heat conductivity as possible is preferably used as the elastic layer 41*b* from a viewpoint of a quick start. Accordingly, silicone rubber having a thickness of approximately 250 μm and a heat conductivity of approximately 1.3 W/mK is used as the elastic layer 41*b* in the embodiment.

The releasable layer 41*c* is provided to prevent an offset phenomenon that occurs when toner is once attached to the surface of the fixing sleeve 41 and then moved to the recording material P again. Fluororesin such as PTFE or PFA, silicone resin, or the like is used as the material of the releasable layer 41*c*. In the embodiment, the releasable layer 41*c* is a PFA tube having a thickness of approximately 30 μm and the outer peripheral surface of the silicone rubber, which is the elastic layer 41*b*, is coated with the PFA tube.

Pressurizing Roller

The pressurizing roller 42 is obtained by forming a 3-mm thick conductive silicone rubber layer as an elastic layer 42*b* on the outer peripheral surface of a cylindrical metal core 42*a* and coating the outer peripheral surface of the rubber layer with a 50-μm thick PFA tube as a releasable layer 42*c*. Both ends of the metal core 42*a* are held by the frame of the fixing device 40 via bearings (not illustrated) so that this pressurizing roller 42 faces the heater 60 in parallel. The roller portion of the pressurizing roller 42 includes the elastic layer 42*b* and the releasable layer 42*c* and has an outer diameter of 25 mm and a longitudinal width of 325 mm.

This pressuring roller 42 is rotationally driven in the direction of the arrow by driving section M, which will be described later, including a motor and the like. The fixing sleeve 41 follows the pressurizing roller 42 to rotate around a heater holder 61 at the same speed as the rotation speed of the pressurizing roller 42 by a frictional force between the fixing sleeve 41 and the pressurizing roller 42.

Heater

The heater 60 has a slender board 60*a* extending in a longitudinal direction orthogonal to the transport direction of the recording material. This board 60*a* is an insulating board that is made of ceramic such as alumina or aluminum nitride and has good heat conductivity. In this embodiment, the substrate 60*a* is made of alumina formed in a rectangle having a thickness of 1 mm, a width of 8 mm, and a longitudinal size of 375 mm in consideration of the balance between heat capacity and strength.

On the back surface of the substrate 60*a*, a resistance heating element layer 60*b* as a heating element is formed along the longitudinal direction of the substrate 60*a*. The resistance heating element layer 60*b* mainly includes AgPd alloy, NiSn alloy, $RuO_2$ alloy, or the like and is formed to have a thickness of approximately 10 μm, a length of 310 mm, and a width of 4 mm. The resistance heating element layer 60*b* generates heat by receiving electricity from a power supply (not illustrated) via both ends thereof.

The resistance heating element layer 60*b* is overcoated with an insulating glass layer 60*d* to ensure insulation with external conductive members, give a corrosion-proof function of preventing the resistance of the resistance heating element layer 60*b* from being changed by oxidation or the like, and prevent mechanical damage. The insulating glass layer 60*d* has a thickness of 30 μm.

Reference numeral 60*e* represents a 6-μm thick sliding layer, made of imide resin such as polyimide or polyamide imide, that is provided on the surface of the substrate 60*a* that slides on the inner peripheral surface of the fixing sleeve 41. The sliding layer 60*e* has good heat resistance, lubricity, and wear resistance and has smooth slidability with the inner peripheral surface of the fixing sleeve 41.

Recording Material Information Obtainment Section

Recording material information is detected by a recording material determination section 80 provided in the image forming apparatus illustrated in FIG. 1. The recording material determination section in the embodiment has the structure in which the recording material is sandwiched between an ultrasonic transmission element and an ultrasonic reception element and the basis weight of the recording material is detected on the basis of the attenuation amount of the ultrasonic wave.

The recording material information input section may detect the basis weight of the recording material on the basis of information other than the attenuation amount of the ultrasonic wave.

Alternatively, a print mode or recording material information specified by a user may be used.

That is, any information other than the above may be used as long as the information indicates the hardness (ease of curling) of a recording material.

Fixing Separation Member

As illustrated in FIG. 3, a fixing separation member 65 is disposed on the downstream side of a fixing nip N in the transport direction of the recording material P and guides the transport of the recording material P after the recording material P passes through the fixing nip N. The closer the fixing separation member 65 is to the fixing sleeve 41, the higher the effect of preventing a winding jam. When the fixing separation member 65 comes into contact with the fixing sleeve 41, however, the surface of the fixing sleeve 41 is damaged, possibly causing an image defect. Accordingly, the fixing separation member 65 is disposed away from the fixing sleeve 41 by a predetermined distance.

Winding Jam Generation Mechanism

Figure 5A:
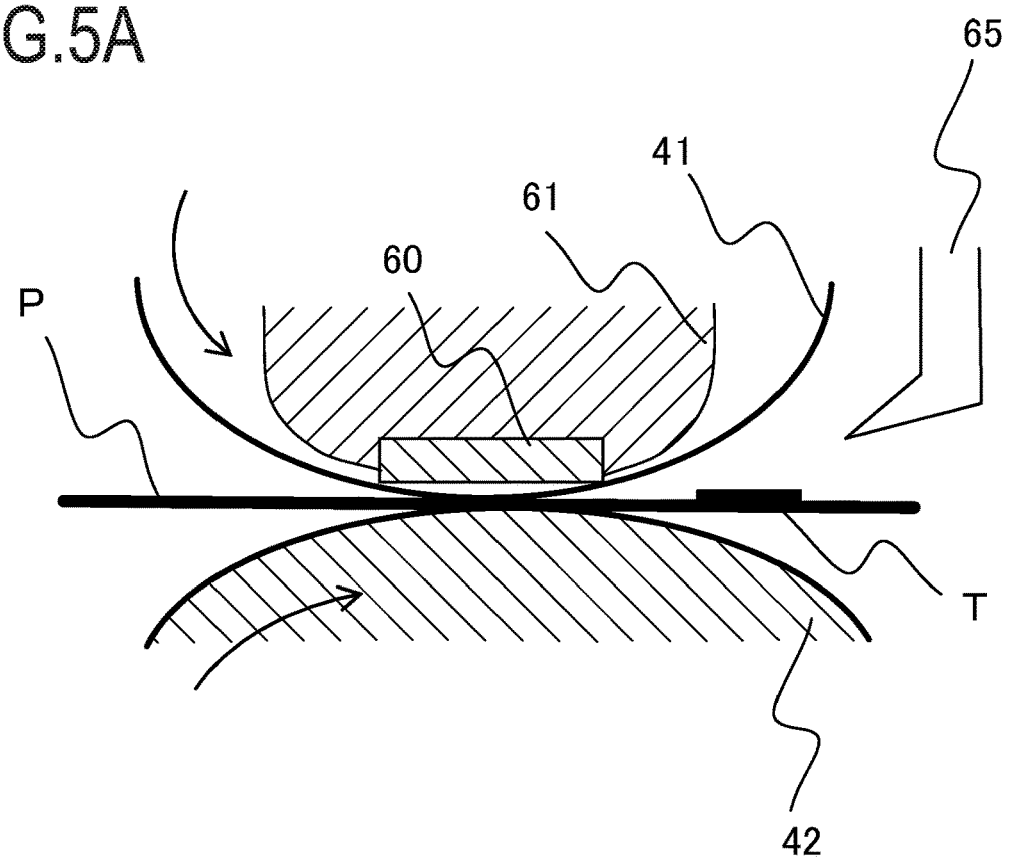
FIGS. 5A and 5B are explanatory diagrams illustrating a generating mechanism of a winding jam in the first embodiment.
Figure 5B:
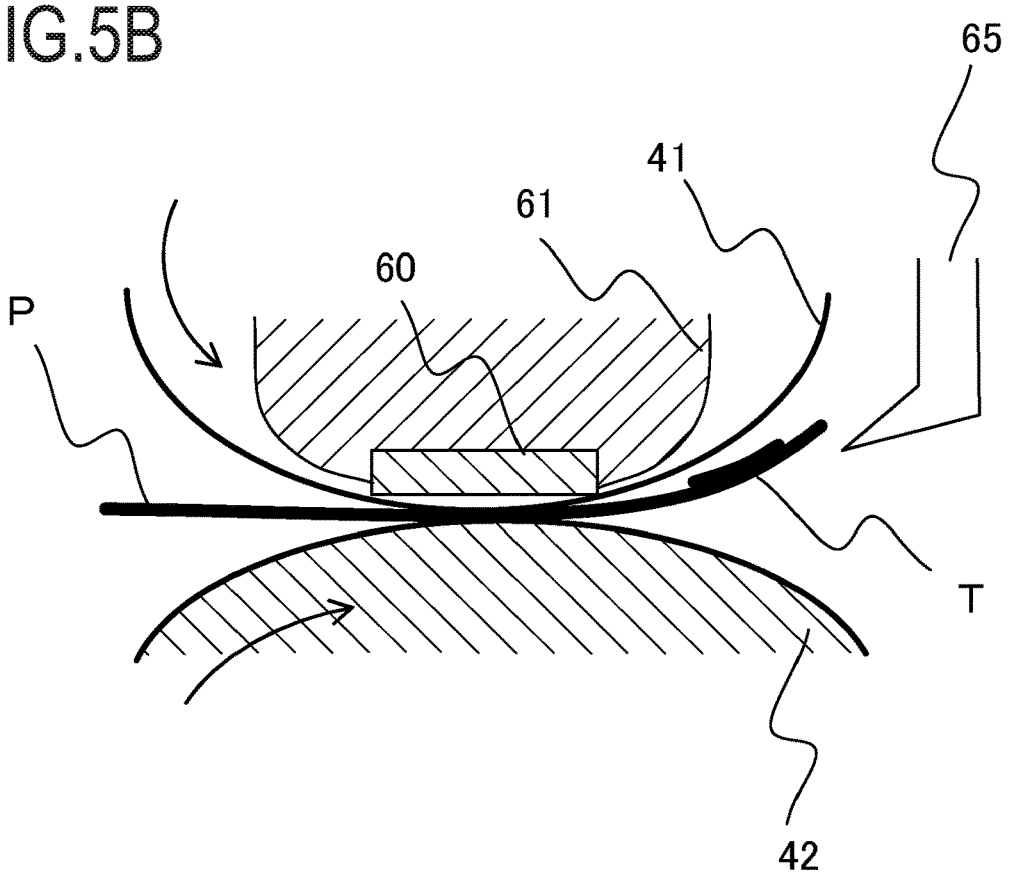

FIGS. 5A and 5B are enlarged views illustrating the vicinity of the fixing nip portion of the fixing device 40 that is passing through the recording material. An unfixed toner image T on the recording material P enters the fixing nip and is heated and melted. Since the heated and melted toner image T is viscous, an adhesion force is generated between the recording material P and the surface of the fixing sleeve 41. When the adhesion force is small or the hardness of the recording material is large (does not easily curl), the recording material P is separated from the fixing sleeve 41 and transported to the downstream side as illustrated in FIG. 5A. When the adhesion force is large or the hardness of the recording material is small (easily curls), although the recording material P is not easily separated from the fixing sleeve 41, the recording material P is separated from the fixing sleeve 41 by the fixing separation member 65 and transported to the downstream side.

When the adhesion force is large and the hardness of the recording material is small, however, the leading end of the recording material is wound around the fixing sleeve 41 and may sneak between the fixing sleeve 41 and the fixing separation member 65 as illustrated FIG. 5B. When the recording material is not appropriately transported to the downstream side of the fixing nip, a recording material presence/absence sensor (not illustrated) on the downstream side of the fixing nip detects a winding jam.

The fixation temperature and the amount of toner have effects on the adhesion force between the recording material P and the fixing sleeve 41. When the fixation temperature is high, the viscosity of the toner image increases, and the recording material P is not easily separated from the fixing sleeve 41. The larger the amount of toner present between the fixing sleeve 41 and the recording material P, the larger the adhesion force.

In addition, the basis weight and the humidity of the recording material have effects on the hardness of the recording material P. When the humidity is high, the recording material absorbs moisture and the inter-fiber bond of the paper becomes weak, thereby lowering the hardness.

As described above, the tendency of occurrence of a winding jam is illustrated in Table 1 below.

TABLE 1

Tendency of Occurrence of a Winding jam

| | Tendency of Occurrence of a Winding jam | | | |
|---|---|---|---|---|
| | Not easily occur | | | Easily occur |
| Amount of toner | Little | | | Much |
| Leading-end margin | Large | ← | → | Small |
| Basis weight of recording material | Large | ← | → | Small |
| Humidity | Low | ← | → | High |
| Fixation temperature | Low | ← | → | High |

Winding Jam Countermeasure Control Execution Unit

As illustrated in the Table 2 below, a countermeasure control execution portion 210 stores four modes for changing the fixation temperature change amount, the preparatory rotation extension time, and the inter-paper extension time as winding jam countermeasure control. Here, the fixation temperature change amount is the temperature change amount from the fixation temperature (target control temperature) when winding jam countermeasure control is not performed. That is, occurrence of a winding jam is prevented by setting the fixation temperature to a low value. In addition, the preparatory rotation time and the inter-paper time are extended to be longer than in the normal image forming mode to ensure the fixing performance when the fixation temperature is set to a low value. That is, the preparatory rotation time from the start of image forming until the first recording material enters (reaches) the fixing device and the inter-paper time from when the rear end of the preceding paper passes through (exits from) the fixing nip in continuous printing until the leading end of the following paper enters the fixing nip are extended. Accordingly, the heat stored in the pressurizing roller 42 in preparatory rotation or inter-paper makes up for the fixing performance of the recording material of the following paper.

TABLE 2

Winding Jam Countermeasure Modes in the First Embodiment

| | Change amount of fixation temperature | Amount of extension of preparatory rotation time | Amount of extension of inter-paper time |
|---|---|---|---|
| Mode 1 | −2° C. | 1 second | 1 second |
| Mode 2 | −4° C. | 3 second | 1 second |
| Mode 3 | −6° C. | 10 seconds | 2 seconds |
| Mode 4 | −8° C. | 15 seconds | 3 seconds |

Mode 1 is selected when a winding jam does not occur relatively easily. In mode 1, (i) the fixation temperature is set to a slightly lower value. In addition, the same fixing performance as the case winding jam countermeasure is not performed is achieved by extending (ii) the preparatory rotation time and (iii) the inter-paper time by one second.

Mode 2 is selected when a winding jam occurs more easily than in the condition in which mode 1 is selected. Mode 2 prevents occurrence of a winding jam by setting the fixation temperature to a value lower than in mode 1.

Mode 3 and mode 4 address the case in which a winding jam is determined to occur more easily by setting the fixation temperature to a lower value and extending the preparatory rotation time and the inter-paper time.

The countermeasure control execution portion controls the fixing control portion 207 and the transport control portion 208 to execute the above countermeasure mode selected by a countermeasure control selection portion, which will be described later. The image forming operation performed by the above countermeasure mode corresponds to the second image forming mode according to the present invention.

Winding Jam Countermeasure Control Selection Unit

Figure 6:
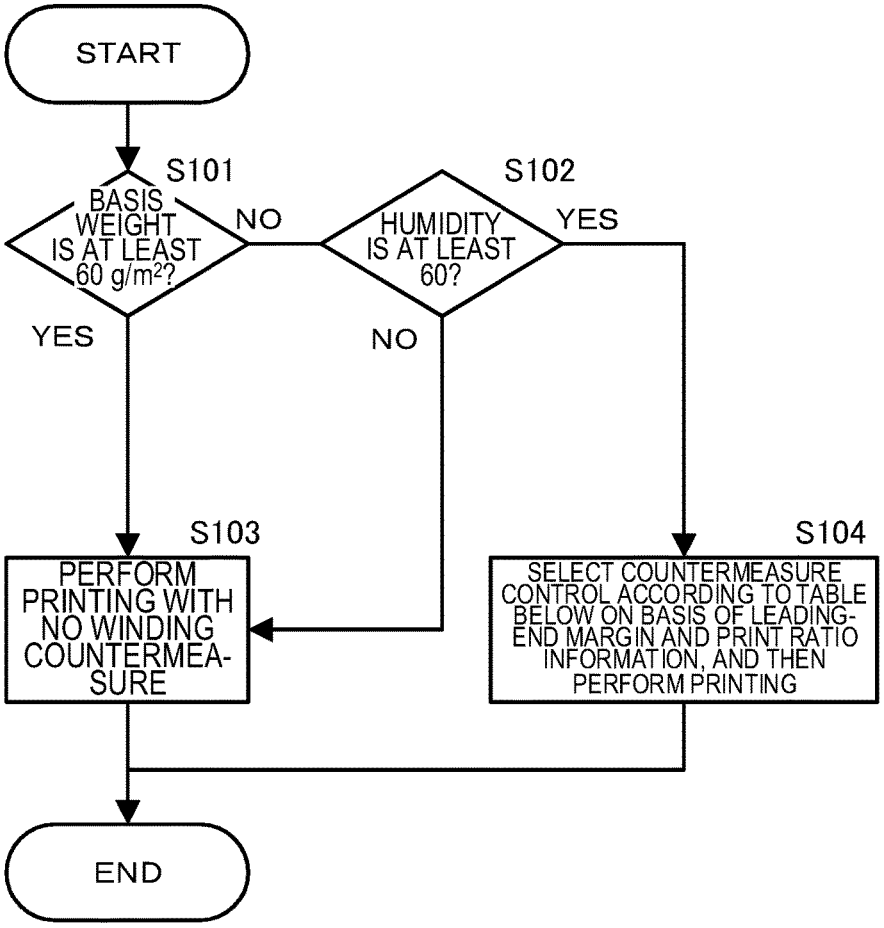
FIG. 6 is an explanatory diagram illustrating fixing winding countermeasure control in the first embodiment.

The countermeasure control selection portion 209 selects the optimum mode from the four modes as winding jam countermeasure control illustrated in Table 2 on the basis of the tendency of occurrence of a winding jam as illustrated in Table 1 described above. FIG. 6 describes the method by which the countermeasure control selection portion 209 selects the optimum fixing winding countermeasure control.

In the image forming apparatus, the presence or absence of a winding jam with respect to changes in the basis weight of the recording material, the humidity environment, and the image condition was checked. As a result, for the recording material having a basis weight of at least 60 g/m$^2$, a winding jam did not occur regardless of the image information or environment. In addition, for the recording material (CS-520) having a basis weight of 52 g/m$^2$, a winding jam did not occur in an environment having a humidity of 60%.

Accordingly, as illustrated in the flowchart in FIG. 6, for the recording material having a basis weight of at least 60 g/m$^2$ (YES in S101), printing is performed with no winding countermeasure (S103). In addition, even for the recording material having a basis weight of less than 60 g/m$^2$ (NO in S101), when the humidity is less than 60% (NO in S102), printing is performed with no winding countermeasure (S103).

In contrast, when the basis weight is less than 60 g/m$^2$ and the humidity is at least 60% (NO in S101 and YES in S102), it was found that a winding jam could be prevented in the countermeasure modes illustrated in the table in FIG. 6 depending on the combination of the front-end margin amount of an image and the front-end image printing ratio. Accordingly, when the basis weight is less than 60 g/m$^2$ and the humidity is at least 60%, one of the modes illustrated in the table in FIG. 6 is selected depending on the front-end margin and the front-end image print ratio (S104).

Although the humidity is used as the information of the environment in which the image forming apparatus is installed in the embodiment, the absolute moisture content calculated on the basis of the temperature and the humidity or a combination of the humidity and the absolute moisture content may be used.

Comparative Experiment

In the control described above, the presence or absence of a winding jam, the fixing performance, the first print out time (FPOT), and the time required for 50 prints were measured.

The same check was performed for comparative example 1 in which winding jam countermeasure control was not performed, comparative example 2 in which only the fixation temperature was changed as winding countermeasure control as illustrated in Table 3, and comparative example 3 in which the fixation temperature was lowered, the preparatory rotation time was extended, and the inter-paper time was extended as illustrated in Table 4.

TABLE 3

Winding Countermeasure Control in Comparative Example 2

| | Fixation temperature |
|---|---|
| Mode 1 in comparative example 1 | −2° C. |
| Mode 2 in comparative example 1 | −4° C. |
| Mode 3 in comparative example 1 | −6° C. |
| Mode 4 in comparative example 1 | −8° C. |

TABLE 4

Print Control in Comparative Example 3

| | Change amount of fixation temperature | Amount of extension of preparatory rotation time | Amount of extension of inter-paper time |
|---|---|---|---|
| Comparative example 3 | −8° C. | 15 seconds | 3 seconds |

The check condition was that the basis weight is 52 g/m$^2$ in the environment with a humidity of 80% and the A4-size recording material (CS-520) was continuously printed (continuous image forming was performed across a plurality of recording materials) while being fed laterally (the longer sides are the leading end and the rear end).

The following three conditions in the Table 5 below were set as the front-end margin and the front-end image print ratio and an image with a print ratio of 200% (yellow toner 100%+magenta toner 100%) was formed at the image rear end to check fixing performance.

TABLE 5

Print Conditions of Comparative Experiment

| | Condition 1 | Condition 2 | Condition 3 |
|---|---|---|---|
| Leading-end margin | 5 mm | 4 mm | 2 mm |
| Leading-end image print ratio | 50% | 50% | 90% |

Condition 1 is the condition under which no winding jam countermeasure is performed, condition 2 is the condition under which mode 2 is selected in the embodiment and the comparative example 2, and condition 3 is the condition under which mode 4 is selected in the embodiment and comparative example 2.

The results checked under condition 1 are illustrated in Table 6.

Under condition 1, in the embodiment, comparative example 1, and comparative example 2, printing is performed with no winding jam countermeasure on the basis of the front-end margin and the front-end image print ratio. Accordingly, a winding jam does not occur, the fixing performance is not degraded, and FPOT and the paper pass-through time are not extended. In contrast, since the preparatory rotation time is extended and the inter-paper time is extended uniformly in the comparative example 3, the condition of occurrence of a winding jam is not met, but FPOT and the paper pass-through time are extended significantly.

TABLE 6

Comparative Experiment Result under Print Condition 1

| | Condition 1 | | | |
|---|---|---|---|---|
| | Present embodiment | Comparative example 1 | Comparative example 2 | Comparative example 3 |
| Fixing winding | ○ (good) | ○ (good) | ○ (good) | ○ (good) |
| Fixing performance | ○ (good) | ○ (good) | ○ (good) | ○ (good) |
| FPOT | 10 seconds | 10 seconds | 10 seconds | 25 seconds |
| Paper pass-through time | 120 seconds | 120 seconds | 120 seconds | 280 seconds |

Next, the results checked under condition 2 are illustrated in Table 7.

Under condition 2, fixing winding countermeasure mode 2 is selected on the basis of the front-end margin and the front-end image print ratio in the embodiment and comparative example 2. In the embodiment, the fixing performance is obtained by extending the preparatory rotation time and the inter-paper time while preventing a winding jam by lowering the fixation temperature. In contrast, since only the fixation temperature was lowered in countermeasure mode 2 in comparative example 2, a winding jam did not occur, but the fixing performance was degraded. In addition, a winding jam occurred during continuous printing in comparative example 1. Since the preparatory rotation time is extended and the inter-paper time is extended uniformly in comparative example 3, FPOT and the paper pass-through time are extended significantly.

TABLE 7

Comparative Experiment Result under Print Condition 2

| | Condition 2 | | | |
|---|---|---|---|---|
| | Present embodiment | Comparative example 1 | Comparative example 2 | Comparative example 3 |
| Fixing winding | ○ (good) | X (bad) | ○ (good) | ○ (good) |
| Fixing performance | ○ (good) | ○ (good) | Δ (not good) | ○ (good) |
| FPOT | 13 seconds | 10 seconds | 10 seconds | 25 seconds |
| Paper pass-through time | 180 seconds | — seconds | 120 seconds | 280 seconds |

Next, the results checked under condition 3 are illustrated in Table 8.

In condition 3, fixing winding countermeasure mode 4 is selected in the embodiment and comparative example 2.

In addition, the control in comparative example 3 is also similar to the control in fixing winding countermeasure mode 4 in the embodiment. Accordingly, a winding jam did not occur and the fixing performance was not degraded in the embodiment and comparative example 3. In contrast, a winding jam occurred in the first paper in comparative example 1.

In addition, since only the fixation temperature was lowered significantly in countermeasure mode 4 in comparative example 2, the fixing performance was significantly degraded.

TABLE 8

Comparative Experiment Result in Print Condition 3

| | Condition 3 | | | |
|---|---|---|---|---|
| | Present embodiment | Comparative example 1 | Comparative example 2 | Comparative example 3 |
| Fixing winding | ○ (good) | X (bad) | ○ (good) | ○ (good) |
| Fixing performance | ○ (good) | — | X (bad) | ○ (good) |
| FPOT | 25 seconds | — seconds | 10 seconds | 25 seconds |
| Paper pass-through time | 280 seconds | — seconds | 120 seconds | 280 seconds |

As described above, the embodiment is provided with a winding jam countermeasure mode for obtaining fixing performance by extending the preparatory rotation time and the inter-paper time when the fixation temperature is lowered, and this winding jam countermeasure mode is selected by the countermeasure control selection portion. This can prevent a winding jam without the degradation of the fixing performance and the unnecessary delay of FPOT and the paper pass-through time.

Although the image print ratio is used as the image information in the embodiment, the image coverage ratio or a combination of the image print ratio and the image coverage ratio may be used to obtain the same effect.

In addition, although the table in FIG. 6 assumes that both the front-end image print ratio information and the front-end margin information are obtained in the embodiment, any one of both may be obtained and the print mode may be selected. When the front-end margin information cannot be obtained due to reasons of the controller portion 201 and the video interface portion 204 or the like, the print mode may be selected according to the front-end image print ratio information by assuming the front-end margin information to be a front-end margin condition (up to 2 mm) that makes fixing winding severe. In addition, when the front-end image print ratio information cannot be obtained, the print mode may be selected according to the front-end margin information by assuming the front-end image print ratio information to be front-end image print ratio information (80% or more) that makes fixing winding severe.

Second Embodiment

Next, a second embodiment will be described. Since the structures of the image forming apparatus and the heat-fixing device according to the embodiment are the same as those in FIG. 1 to FIG. 4 according to the first embodiment, descriptions thereof are omitted.

In the second embodiment, winding jam prevention control when the image forming apparatus has a wide color gamut setting for widening the color gamut will be described.

The wide color gamut setting enlarges the color reproduction range and the method that increases the amount of toner (the density of the image) on the recording material by, for example, changing the rotation speed of the developing roller is conventionally known.

That is, the amount of toner loaded per unit area can be made larger than in the normal image forming mode by controlling the peripheral speed ratio between the photoreceptive drum and the developing roller that move in the same direction in the developing section so that the peripheral speed (the movement speed of the peripheral surface) of the developing roller is faster than the peripheral speed of the photoreceptive drum.

In this case, even when print ratio information received from the controller is the same between the normal setting (other than the wide color gamut setting) and the wide color gamut setting, the amount of toner actually formed on the recording material for wide color gamut setting is larger than in the normal setting and a winding jam easily occurs.

Accordingly, in the wide color gamut setting of the second embodiment, the amount of toner actually formed on the recording material is determined on the basis of the image print ratio information and the ratio of the peripheral speed of the developing roller to the peripheral speed of the photoreceptive drum and the determined toner amount is used to select the winding jam countermeasure control.

For the image forming apparatus having the wide color gamut setting, the countermeasure control selection portion 209 selects the winding jam countermeasure mode according to the flowchart in FIG. 7.

Even in the wide color gamut setting, for the recording material having a basis weight of at least 60 g/m$^2$, a winding jam did not occur regardless of the image information or the environment. Accordingly, for the recording material having a basis weight of at least 60 g/m$^2$ (YES in S201), printing is performed with no winding countermeasure (S205). In addition, even in the wide color gamut setting, for the recording material having a basis weight of less than 60 g/m$^2$ (NO in S201), a winding jam did not occur regardless of the image information as long as the humidity is less than 40% (NO in S202). Accordingly, even in the wide color gamut setting, printing is performed with no winding countermeasure (S205) when the humidity is less than 40% (NO in S202). In contrast, it was found that the winding jam countermeasure control illustrated in Table B in FIG. 7 was required to prevent a winding jam unlike the normal setting when the basis weight is less than 60 g/m$^2$ and the humidity is at least 40% and less than 60% (YES in S202, YES in S203, and NO in S204) in the wide color gamut setting. Accordingly, as illustrated in Table B in FIG. 7, the winding countermeasure control is selected on the basis of the front-end margin and the image print ratio (S208).

In addition, when the basis weight was less than 60 g/m$^2$ and the humidity was at least 60% (YES in S202, YES in S203, and YES in S204) in the wide color gamut setting, a winding jam could be prevented by selecting the winding jam countermeasure control illustrated in Table C (S209).

As described above, in the image forming apparatus having the wide color gamut setting, the winding countermeasure control different from the normal setting is also selected for the wide color gamut setting. This can prevent a winding jam without the degradation of the fixing performance and the unnecessary delay of FPOT and the paper pass-through time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-236911, filed on Dec. 19, 2018, which is hereby incorporated by reference herein in its entirety.

What is claimed is:

1. An image forming apparatus comprising:

an image forming portion that forms an image on a recording material;

an image fixing portion including a cylindrical film, a heater that comes into contact with an inner surface of the film, and a pressurizing member that forms a nip portion by coming into contact with an outer surface of the film so as to sandwich the film between the pressurizing member and the heater, the image recording material being nipped and transported by the nip portion and the image being heated by heat of the heater; and a control portion that controls the image forming portion and the image fixing portion, wherein the control portion has a second image forming mode that (i) controls a target control temperature of the heater to be lower than in a normal image forming mode and (ii) extends a preparatory rotation time until the recording material enters the fixing portion to be longer than in the normal image forming mode based on recording material information indicating a hardness of the recording material is below a reference hardness, at least one of margin information indicating a size of a margin at a leading end of the recording medium in a transport direction of the recording material and toner amount information at the leading end of the image, and information indicating a humidity around the image forming apparatus is above a reference humidity.

2. The image forming apparatus according to claim 1, wherein, in the second image forming mode, the control portion in addition to extending the preparatory rotation time until the recording material enters the fixing portion, extends a distance between a rear end of a preceding recording material and a leading end of a following recording material to be longer than in the normal image forming mode when respective images are formed continuously on a plurality of recording materials.

3. The image forming apparatus according to claim 1, wherein the recording material information is either a basis weight of the recording material or a type of the recording material.

4. The image forming apparatus according to claim 1, wherein the toner amount information is either a coverage ratio of the image excluding a margin region at the leading end or density information of the image at the leading end.

5. The image forming apparatus according to claim 1, wherein the information indicating the humidity around the image forming apparatus is at least one of a humidity of a periphery of the image forming apparatus and an absolute moisture content obtained from the humidity and ambient temperature.

6. An image forming apparatus comprising:

an image forming portion that forms an image on a recording material;

an image fixing portion including a heater for heating an image formed on the recording material; and a control portion that controls the image forming portion and the image fixing portion, wherein in a case where a hardness of the recording material is lower than a reference hardness, a humidity around the image forming apparatus is higher than a reference humidity, and the image exists in a predetermined area at a leading end of the recording material or a toner amount of the image existing in the predetermined area is higher than a reference toner amount, the control portion sets a target control temperature of the heater when heating the image existing in the predetermined area to be lower than that in a normal image forming mode and extends a preparatory rotation time until the recording material enters the fixing portion to be longer than that in the normal image forming mode.

7. The image forming apparatus according to claim 6, wherein, in a case where the hardness of the recording material is lower than the reference hardness, the humidity around the image forming apparatus is higher than the reference humidity, and the image exists in the predetermined area at the leading end of the recording material or the toner amount of the image existing in the predetermined area is higher than the reference toner amount, the control portion in addition to extending the preparatory rotation time until the recording material enters the fixing portion, extends a distance between a rear end of the preceding recording material and a leading end of the following recording material to be longer than in the normal image forming mode when respective images are formed continuously on a plurality of recording materials.

8. The image forming apparatus according to claim 6, wherein in a case where either a basis weight of the recording material is smaller than a reference basis weight or a type of the recording material is a thin paper, the control portion sets the target control temperature of the heater when heating the image existing in the predetermined area to be lower than that in the normal image forming mode and extends the preparatory rotation time until the recording material enters the fixing portion to be longer than that in the normal image forming mode.

9. The image forming apparatus according to claim 6, wherein the toner amount is either a coverage ratio of the image excluding a margin region at the leading end or a density information of the image at the leading end.

10. The image forming apparatus according to claim 6, wherein the humidity around the image forming apparatus is at least one of a humidity of a periphery of the image forming apparatus and an absolute moisture content obtained from the humidity and ambient temperature.

11. The image forming apparatus according to claim 6, wherein the image fixing portion includes a cylindrical film, a heater provided in an inner space of the film, and a roller in contact with an outer surface of the film to form a fixing nip portion in cooperation with the heater through the film.

12. An image forming apparatus comprising:

an image forming portion that forms an image on a recording material;

an image fixing portion including a heater for heating an image formed on the recording material; and a control portion that controls the image forming portion and the image fixing portion, wherein in a case where a hardness of the recording material is lower than a reference hardness, a humidity around the image forming apparatus is higher than a reference humidity, and the image exists in a predetermined area at a leading end of the recording material or a toner amount of the image existing in the predetermined area is higher than a reference toner amount, the control portion extends a preparatory rotation time until the recording material enters the fixing portion to be longer than that in a normal image forming mode.

13. The image forming apparatus according to claim 12, wherein the image fixing portion includes a cylindrical film, a heater provided in an inner space of the film, and a roller in contact with an outer surface of the film to form a fixing nip portion in cooperation with the heater through the film.

14. An image forming apparatus comprising:

an image forming portion that forms an image on a recording material;

an image fixing portion including a heater for heating an image formed on the recording material; and a control portion that controls the image forming portion and the image fixing portion, wherein in a case where a hardness of the recording material is lower than a reference hardness and a humidity around the image forming apparatus is higher than a reference humidity, the control portion sets a target control temperature of the heater when heating the image existing in a predetermined area at a leading end of the recording material to be lower than that in a normal image forming mode and extends a preparatory rotation time until the recording material enters the fixing portion to be longer than that in the normal image forming mode.

15. The image forming apparatus according to claim 14, wherein the image fixing portion includes a cylindrical film, a heater provided in an inner space of the film, and a roller in contact with an outer surface of the film to form a fixing nip portion in cooperation with the heater through the film.

* * * * *